United States Patent [19]

Keintzel et al.

[11] Patent Number: 4,674,567

[45] Date of Patent: Jun. 23, 1987

[54] DEVICE FOR MOUNTING A CONDUIT IN AN OPENING OF A PLATE

[75] Inventors: Günter Keintzel, Gummersbach; Arno Czimczik, Kreuztal, both of Fed. Rep. of Germany

[73] Assignee: L. & C. Steinmüller GmbH, Gummersbach, Fed. Rep. of Germany

[21] Appl. No.: 811,498

[22] Filed: Dec. 20, 1985

[30] Foreign Application Priority Data

Dec. 22, 1984 [DE] Fed. Rep. of Germany ..... 3447264

[51] Int. Cl.[4] ..... F28D 7/00

[52] U.S. Cl. ..... 165/162; 285/158; 285/286

[58] Field of Search ..... 285/158, 286

[56] References Cited

U.S. PATENT DOCUMENTS

| | | | |
|---|---|---|---|
| 2,013,660 | 9/1935 | Laver | 285/158 X |
| 2,056,920 | 10/1936 | Demann | 165/162 X |
| 2,252,069 | 8/1941 | Fletcher | 285/158 X |
| 2,528,180 | 10/1950 | Roehl | 285/158 |
| 3,438,655 | 4/1969 | Campbell | 285/158 |
| 3,572,770 | 3/1971 | Kagi | 165/162 X |
| 4,199,853 | 4/1986 | Fricker | 285/158 X |
| 4,305,453 | 12/1981 | Wagner | 165/162 X |

*Primary Examiner*—Albert W. Davis, Jr.
*Assistant Examiner*—Peggy Neils
*Attorney, Agent, or Firm*—Becker & Becker, Inc.

[57] ABSTRACT

A device for mounting a conduit in an opening of a plate, especially for mounting a heat-exchanger tube in a support plate of a high-temperature heat exchanger. The tube is mounted in the opening of the support plate via the interposition of at least one sleeve-like wear-protection element, with the positioning of the tube being secured by welding. To guarantee a reliable connection between the plate and the tube that can be tested and can also be utilized at high temperatures, at least one build-up weld is provided on the tube. This build-up weld is in frictional and/or positive engagement with the inner surface of the at least two-part wear-protection element.

8 Claims, 4 Drawing Figures

DEVICE FOR MOUNTING A CONDUIT IN AN OPENING OF A PLATE

BACKGROUND OF THE INVENTION

1. Field of the Invention

The present invention relates to a device or bracket for mounting a conduit in an opening or hole of a plate, especially for mounting a heat-exchanger tube in a support plate of a high-temperature heat exchanger. The tube is mounted in the opening of the plate via the interposition of at least one sleeve-like wear-protection element, with positioning of the tube being secured by welding.

2. Description of the Prior Art

A conduit mounting of this general type is disclosed in German Offenlegungschrift No. 30 01 756, corresponding to U.S. Pat. No. 4,288,109—Ellis dated Sept. 8, 1981. This heretofore known mounting comprises a sleeve-like wear-protection element in the form of a closed sleeve. The two ends of the closed sleeve that extend out of the plate are secured by a groove or keyed connected weld. After the conduit has been pushed through the wear-protection sleeve, the conduit is secured by a similar keyed weld that joins the two parts. It is difficult to check these connection welds not only during assembly of the conduit mounting, but also during retesting.

German Auslegeschrift No. 16 01 243, corresponding to U.S. Pat. No. 3,572,770—Kagi dated Mar. 30, 1971 a conduit mounting for transversely disposed conduits that are respectively guided, with play, in the openings of at least one support plate via a sleeve, with the sleeve being made of the material that makes it difficult to weld the sleeve to the support plate at high temperatures. The connection of the sleeve with the conduit is effected with the aid of a conical sleeve. During assembly of this heretofore known conduit mounting, the first sleeve is initially pushed onto the conduit before the latter is inserted through the hole in the support plate. After the conduit has been correctly positioned in the support plate, the first sleeve is pushed into the hole of the support plate and the second sleeve is driven or pressed thereon. Subsequently, the two sleeves are welded together, and via the additional application of weld material are secured as a unit from slipping out of the support plate.

With these heretofore known means for securing conduits, what is involved is connections of the conduits with the conduit plate where the connections can either not be sufficiently checked or tested, or are merely frictional connections that can be utilized only to a temperature of about 700° C., since at higher temperatures a conduit mounting using clamping or tensioning elements is easily adversely affected as a result of reduction of tension due to the temperature, so that such a conduit mounting fails at such temperatures.

An object of the present invention is to provide a conduit mounting of the aforementioned general type which assures a reliable connection between the plate and the conduit, whereby the connection can be tested and can also be utilized at high temperatures.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
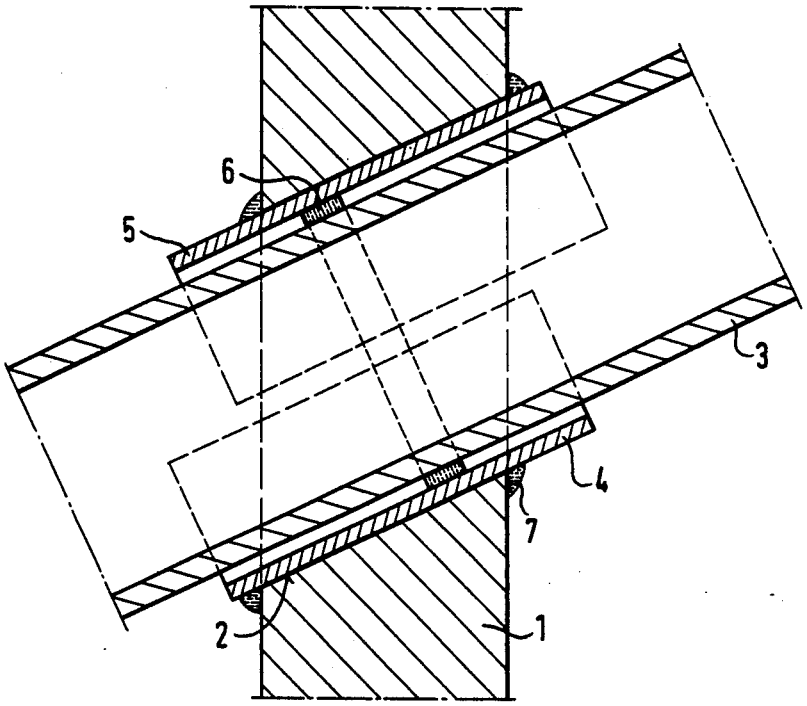
FIG. 1 is a view showing a partial longitudinal section of one embodiment of the inventive device showing a frictional connection of a tube with a support plate and two interposed sleeve parts as a loose mounting.

The device of the present invention comprises an at least two-part, sleeve-like wear-protection element that is interposed between the tube and the opening of the support plate for positioning the tube in the opening; and at least one build-up weld disposed on the tube between the latter and the wear-protection element, with the build-up weld being in engagement with the inner surface of the wear-protection element for securing the positioning of the tube in the opening of the support plate.

The build-up weld applied to the tube is distinguished by the fact that it is particularly easy to check or test. In contrast to the ability to check connection welds, especially keyed welds, considerably more favorable conditions can be anticipated for checking the build-up welds; this is also true for repeated testing. Thus, with regard to a nuclear quality guarantee method (for example during the manufacture of primary circuit components), the requirements regarding reproducibility and documentation of the manufacturing and method data are fulfilled without difficulty.

The build-up weld is preferably an annular weld. Such an annular build-up weld can be produced with a mechanized orbital welding unit. However, in place of an annular, closed build-up weld, it is also possible to apply sector-like build-up welds over defined sections of the periphery. The weld can also be applied helically. Furthermore, it is also conceivable to apply build-up welds in the longitudinal direction of the tube. The essential point is only that the build-up weld be applied to the tube and be in frictional and/or positive engagement with the inner surface of the wear-protection element.

In the event that a protective coating is to be provided for protecting against frictional wear, such a coating can be applied to the wear-protection element or elements in a separate procedure independent of the tubes. It is thus possible to avoid an expensive direct coating of the tube, and hence also the disposition of the friction location directly on the wall of the tube.

Pursuant to a straight forward embodiment of the inventive tube mounting, the outer surface of the build-up weld can frictionally contact the inner surface of the two parts of the wear-protection element.

In some applications, however, it may be expedient to provide the inner surface of the two parts of the wear-protection element with ribs that extend in the circumferential direction of the tube, with the build-up weld contacting these ribs. In this case, a frictional and positive engagement is provided. In other situations, it may be expedient to provide the two parts of the wear-protection element with a groove that extends in the circumferential direction of the tube, with the groove resting positively upon the build-up weld.

Finally, it is also possible, in order to provide a wedged-sleeve arrangement, to taper the two parts of the wear-protection element and to surround them with an outer clamping sleeve.

Further advantageous specific features of the present invention will be described subsequently.

DESCRIPTION OF PREFERRED EMBODIMENTS

Referring now to the drawings in detail, in the embodiment of FIG. 1 the mounting arrangement comprises a stationary support plate 1 that is embodied as a loose support and has a hole or opening 2 through which a conduit or tube 3 is inserted. The opening 2 in the support plate 1 is larger than the outer diameter of the tube 3. Disposed between the opening 2 in the support plate 1 and the tube 3 is a wear-protection element that comprises two sleeve parts 4 and 5. These parts 4 and 5 are welded onto the support plate 1 and nearly completely surround the tube 3, with a narrow gap remaining between the parts 4, 5 and the tube 3. Provided between the sleeve parts 4 and 5 is an annular application or build-up weld 6, which is particularly distinguished by being able to be easily checked or tested. As a result of this annular build-up weld 6, which can be easily produced with the aid of a mechanized orbital welding unit, and as a result of connection-welding the sleeve parts 4 and 5 to the support plate 1, a frictional mounting of the tube 3 in the support plate 1 is achieved in a very advantageous manner. This mounting can even withstand high thermal stresses, i.e. temperatures well above 700° C. The connection of the sleeve parts 4 and 5 with the support plate 1 can be effected by a positive press fit and/or by annular continuous welds 7. A particular advantage of this mounting of the tube 3 in the sleeve parts 4 and 5 and the support plate 1 by means of the annular build-up weld between tthe sleeve parts 4, 5 and the tube 3 consists in that all stresses caused or occurring as a result of temperature effects, especially very high temperatures, are absorbed by the build-up weld as an element that protects against wear; furthermore, these stresses are kept at a distance from the wall of the tube, or are compensated for by the permissible axial play in such a way that at these locations impermissible stress or friction at the tube wall due to the mounting in the support plate 1 is reliably avoided. In addition, the two-part, half-sleeve embodiment of the wear-protection element contributes very advantageously to compensation of stress in the region of the mounting of the tube 3 in the support plate 1.

Figure 2:
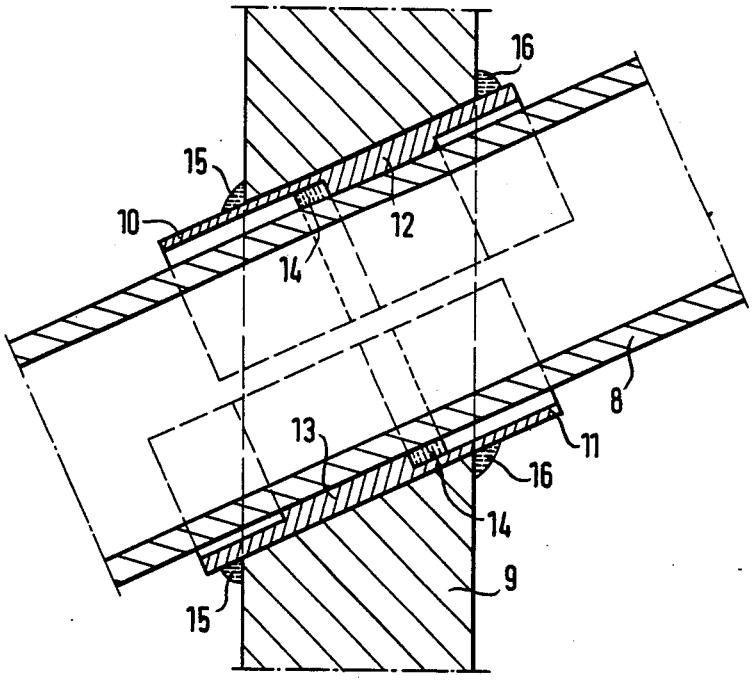
FIG. 2 is a view that shows a frictional and positive connection of a tube with a support plate and two interposed sleeve parts having ribs as a fixed point.

In the embodiment illustrated in FIG. 2, the wear-protection element that is disposed between the tube 8 and the support plate 9 also comprises two sleeve-like parts 10 and 11. However, in this embodiment, the sleeve parts 10 and 11 are provided on their respective inner sides with ribs 12 and 13 that extend in the circumferential direction of the tube 8 and rest against the outer wall of the tube 8. The positive connection of the tube 8 with the support plate 9 via the half-sleeve parts 10 and 11 serves as a fixed point and is again very advantageously effected by an annular build-up weld 14 that is applied to the ribs 12 and 13 and to the inner side of the sleeve parts, as well as by connecting continuous welds 15 and 16. By disposing the ribs 12 and 13 on the inner side of the sleeve parts 10 and 11 there is provided a greater bearing surface for the tube 8. This bearing surface contributes to a particularly stable fixed-point mounting of the tube 8 without adversely affecting the positive connection of the tube 8 with the sleeve parts 10 and 11. An axial play for the tube 8 in the support plate 9 is thereby eliminated.

Finally, the wear-protection element that is disposed between the tube 3 or 8 and the support plate can comprise more than two sleeve parts. Furthermore, a plurality of tubes can be disposed in a single mounting device or bracket, with the tubes preferably extending parallel to one another, and with the number of openings corresponding with the number of tubes.

Figure 3:
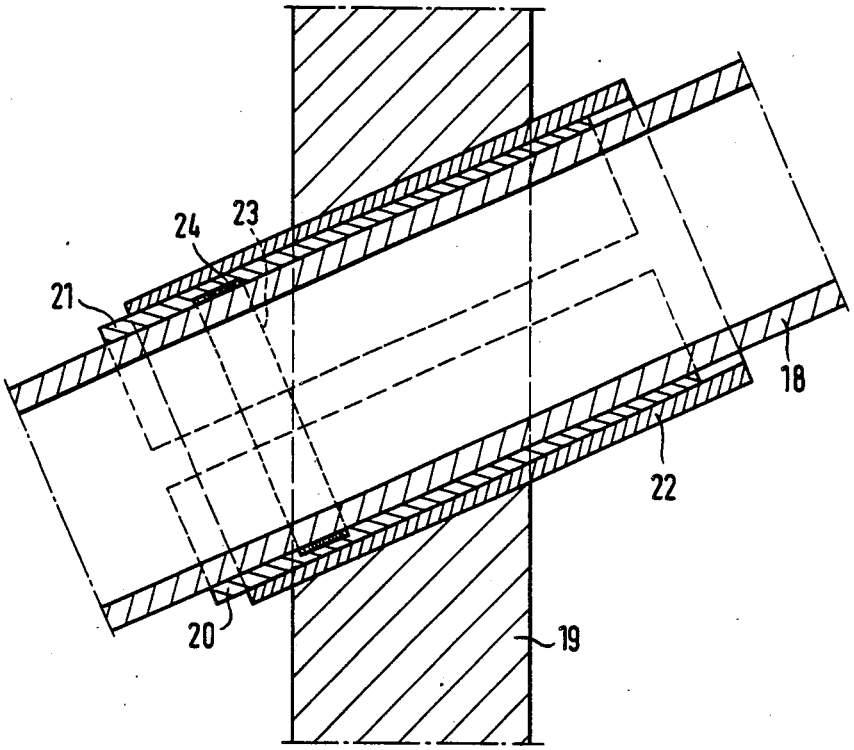
FIG. 3 is a view that shows a frictional and positive connection, in a support plate, of a tube with a sleeve arrangement that acts as a wear-protection element and is in the form of a loose mounting (guide point with play)
Figure 4:
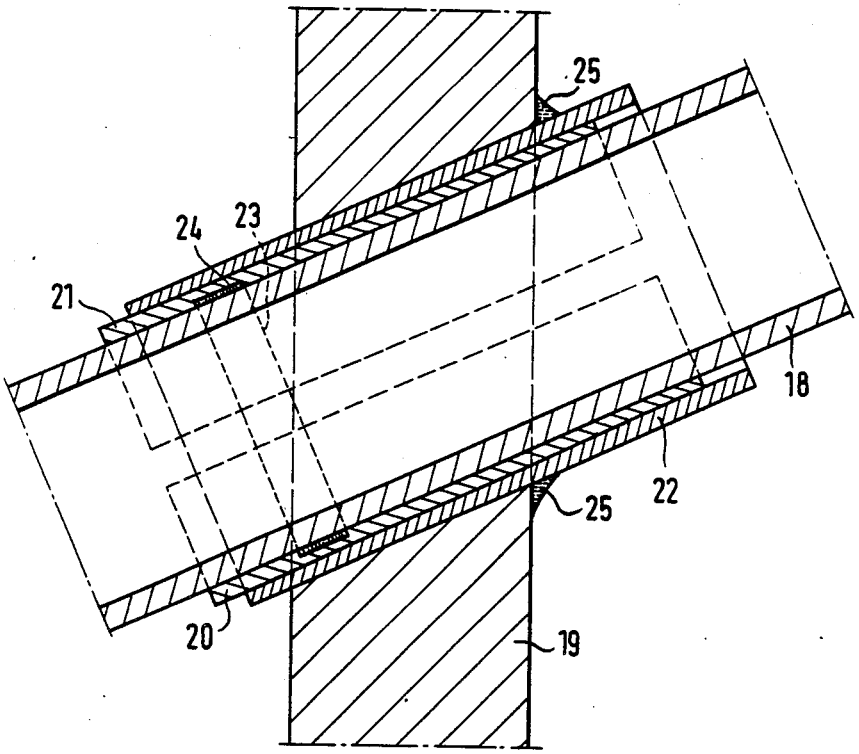
FIG. 4 is a view that shows a frictional and positive connection of a tube with a sleeve arrangement that acts as a wear-protection element and has a fixed point.

The embodiment illustrated in FIG. 3 functions as a loose support mounting for the tube 18 in the support plate 19, and includes, between the support plate 19 and the tube 18, a sleeve arrangement 20, 21, 22 that similarly serves as a wear-protection element. This element comprises an inner one-piece slotted or multi-part conical or tapered split sleeve 20, 21, and an outer conical or tapered clamping sleeve 22. The sleeves 20, 21, 22 are positively, i.e. frictionally, fixed to the tube by being inserted into one another and thus wedged together. The frictional fixation is additionally secured by a positive attachment in that the inner split sleeve 20, 21 is provided on the inner side with a recess or groove 23 that extends in the circumferential direction of the tube 18; the groove 23 rests positively on the build-up weld 24 that is welded in an annular fashion to the outer wall of the tube 18. The parts 20 and 21 of the inner split sleeve are secured at one end to the clamping sleeve 22 via a continuous weld after the tube mounting has been assembled; this is shown at the left in FIGS. 3 and 4. The positive securement of the sleeve arrangement, which acts as a wear-protection element, via an annular build-up weld disposed around the tube, makes it possible in an advantageous manner to use and fix identical sleeve arrangements, that act as wear-protection elements, not only at low operating temperatures (up to 700° C. with only frictional connection and no build-up weld), but also at high operating temperatures (above 700° C. by means of a positive build-up weld). All stresses that occur in the tube mounting, especially frictional stresses resulting from the permissible axial play of the loose support mounting, are first absorbed by the sleeve arrangement, that acts as a wear-protection element, and can thus not act directly upon the wall of the tube. In the embodiment of FIG. 4, the connection of the tube with the support plate via the sleeve arrangement shown in FIG. 3, is also provided with an additional continuous weld 25.

The build-up weld can be reworked prior to placing the parts of the wear-protection element upon the tube.

The present invention is, of course, in no way restricted to the specific disclosure of the specification and drawings, but also encompasses any modifications within the scope of the appended claims.

What is claimed is:

1. A device for mounting a conduit in an opening of a support plate at high temperatures up to and above 700° C. involving stresses caused and occurring as a result of temperature effects, said device comprising:

an at least two-part, sleeve-like wear-protection element that is interposed between said conduit and said opening of said support plate for positioning said conduit in said opening; said wear-protection element having an inner surface that faces said conduit;

at least one build-up weld disposed on said conduit between said conduit and said wear-protection element, with said build-up weld being in engagement with a complimentary or receiving portion on said inner surface of said wear-protection element for securing said positioning of said conduit in said opening of said support plate, and a means to retain said sleeve-like element on said conduit and to fix said element to said support plate, so that all stresses caused and occurring as a result of temperature effects, especially high temperatures are absorbed by said wear-protection element along with said build-up weld and as an element that protects against wear of said conduit mounted in the opening of said support plate.

2. A device according to claim 1, in which said build-up weld is an annular build-up weld.

3. A device according to claim 1, in which said wear-protection element comprises two parts, and in which said build-up weld has an outer surface that rests frictionally against said inner surface of said two-part wear-protection element.

4. A device according to claim 1, in which the inner surface of each of said parts of said wear-protection element is provided with a rib that extends in the circumferential direction of said conduit, with said build-up weld engaging said ribs.

5. A device according to claim 1, in which the inner surface of each of said parts of said wear-protection element is provided with a groove that extends in the circumferential direction of said conduit and positively engages said build-up weld.

6. A device according to claim 5, in which said means comprises a further sleeve disposed between said parts of said wear-protection element and said opening of said support plate; and in which, to provide a wedge-type sleeve arrangement, at least said parts of said wear-protection element have a tapered configuration.

7. A device according to claim 6, in which said further sleeve also has a tapered configuration.

8. A device according to claim 6, in which a continuous weld is provided between said further sleeve and said support plate.

* * * * *